United States Patent [19]

Hanyu et al.

[11] 4,079,683

[45] Mar. 21, 1978

[54] INDICATING ARRANGEMENT FOR USE IN SEWING MACHINES

[75] Inventors: Susumu Hanyu; Noboru Kasuga, both of Hachioji; Isao Ozawa, Hino, all of Japan

[73] Assignee: Janome Sewing Machine Co., Ltd., Tokyo, Japan

[21] Appl. No.: 709,475

[22] Filed: Jul. 28, 1976

[30] Foreign Application Priority Data

| | | |
|---|---|---|
| Aug. 1, 1975 | Japan | 50-94645 |
| Aug. 1, 1975 | Japan | 50-107775[U] |
| Dec. 26, 1975 | Japan | 50-175393[U] |

[51] Int. Cl.[2] ..... D05B 3/02

[52] U.S. Cl. ..... 112/158 F; 112/240; 12/258

[58] Field of Search ..... 112/158 F, 158 A, 158 B, 112/158 C, 158 D, 258, 235, 240; 292/254

[56] References Cited

U.S. PATENT DOCUMENTS

| | | | |
|---|---|---|---|
| 2,314,350 | 3/1943 | Haas | 112/258 |
| 2,848,963 | 8/1958 | Johnson | 112/158 F |
| 3,440,986 | 4/1969 | Fresard | 112/258 |
| 3,871,310 | 3/1975 | Hanyu | 112/158 F |

*Primary Examiner*—Werner H. Schroeder

*Assistant Examiner*—Peter Nerbun

*Attorney, Agent, or Firm*—Michael J. Striker

[57] ABSTRACT

A zig-zag sewing machine equipped with pattern cams and a pattern cam selection arrangement has a compartment in which various accessories of the sewing machine are accommodated. One lid covers the compartment and another lid overlies the above-mentioned lid, the lids being provided, at their surfaces facing one another, with a table of indicia and with lines connecting the indicia with other indicia provided on a pattern cam selector dial so as to enable the user of the sewing machine to adjust the sewing machine for the particular selected stitch pattern. The lids are mounted for pivoting on a common shaft, and a sliding element is mounted on the shaft for displacement therealong and is visible when the one lid is either open or closed, the position of the slide element being selected in dependence on the selected pattern and also being indicative of the accessory to be used. An arresting arrangement arrests the lids in their closed positions for sequential release toward their open positions, and includes two latching elements each of which engages one of the lids, and a connecting element which connects the latching element associated with the one lid to the latching element associated with the other lid only when the other lid is in its open position.

11 Claims, 11 Drawing Figures

INDICATING ARRANGEMENT FOR USE IN SEWING MACHINES

BACKGROUND OF THE INVENTION

The present invention relates generally to sewing machines, and more particularly to zig-zag sewing machines. Still more particularly, the present invention relates to zig-zag sewing machines which have pattern cams and pattern cam selecting mechanisms.

Zig-zag sewing machines are well-known and require no detailed description. Neither is it necessary to elaborate on the fact that many types of such sewing machines are available commercially which render it possible to select a particular stitching pattern by utilizing one or more cams. Such machines usually include pattern cams which are used to make the machine produce a specific stitching pattern, and may also use additional cams for changing the zig-zag amplitude, the needle position and the feeding speed.

It is also known to provide such machines with a pattern panel displaying a plurality of stitching patterns, but the selection of a stitching pattern corresponding to a particular stitching type largely depends on the memory of the operator or on the use of an explanatory manual by the operator. This means that the decision as to which cam to select is cumbersome and time-consuming. Moreover, quite frequently the desired type of stitching pattern is not obtained or not exactly obtained, because of a misunderstanding or faulty memory on the part of the operator, with the result that an undesirable pattern may be produced.

SUMMARY OF THE INVENTION

Accordingly, it is a general object of the invention to overcome the disadvantages of the prior art.

More particularly, it is an object of the invention to provide an improved zig-zag sewing machine wherein these disadvantages are eliminated.

It is a further object of the present invention to provide indicating arrangements on a sewing machine which facilitate the selection of different stitching patterns.

A concomitant object of the present invention is to so design the indicating arrangements as to enable the user of the sewing machine to select the proper accessories of the sewing machine and to adjust the operation of the sewing machine in dependence on the particular stitching pattern selected.

A yet another object of the present invention is to so devise the indicating arrangements as to be simple and give reliable information.

A still another object of the present invention is to so mount the indicating arrangement on the sewing machine as to be compatible with the selection of the stitching patterns, the adjustments of the sewing machine, and the selection of the proper accessories.

In keeping with these objects, and with others which will become apparent hereafter, one feature of the invention resides, briefly stated, in a zig-zag sewing machine of the type having a machine frame, pattern cams, and a pattern cam selecting mechanism including a selector dial which displays a plurality of indicia each representative of a stitching pattern which is produced upon selection of one of the pattern cams, in a combination comprising a first member mounted on the machine frame; a table on said first member displaying additional indicia at least some of which are indicative of sewing machine adjustments to be carried out upon selection of a respective pattern cam; a second member mounted on the machine frame and extending between said first member and the selector dial; and means on said second member for correlating the respective indicia on the selector dial with associated ones of said second indicia on said first member.

Preferably, said first member is a lid mounted on the machine frame for displacement between a first position in which said lid covers said second member, and a second position in which lid uncovers said second member, and said table and said correlating means are provided on surfaces of said lid and of said second member which face one another in said first position of said lid and which are both exposed to view in said second position of said lid.

The sewing machine may further comprise container means attached to said machine frame and defining a compartment for accommodating various attachments of the sewing machine, and said second member may be an additional lid mounted on the machine frame for displacement between a closed position in which said additional lid prevents access to said compartment, and an open position in which said additional lid permits access to said compartment.

Said lid and said additional lid may both be mounted on a common shaft for pivoting between said first and second, and said closed and open, positions thereof, respectively, and an indicating element may be mounted on said shaft for displacement therealong and visible both when said additional lid is in said closed position, and in said open position thereof. The indicating element is then operative for being selectively positioned on said shaft in dependence on the selected indicia, when said additional lid is in said closed position and for indicating the respective accessory to be used, when said additional lid is in said open position.

According to a currently preferred aspect of the present invention, means is provided for arresting said lid and said additional lid in said first and in said closed positions thereof, respectively, the arresting means including an actuating element accessible from the exterior of the sewing machine.

The arresting means may then include a latching element mounted on the machine frame for displacement into and out of engagement with an abutment portion of said lid and connected to said actuating element for displacement in response to actuation of the latter, an additional latching element mounted on the machine frame for displacement into and out of engagement with an additional abutment portion of the additional lid, and means for connecting said additional latching element to said actuating element for displacement of said additional latching element in response to actuation of said actuating element. The connecting means may include a connecting element adapted to engage said additional latching element, and said lid may have a control portion which disengages said connecting element from said additional latching element when said lid is in said first position, and releases said connecting element for engagement with said additional latching element when said lid is in said second position. Preferably, said connecting element is connected to said latching element and has a first engaging portion, said additional latching element has a second engaging portion, and said connecting means includes means for urging said engaging portions toward engagement with one another to thereby interconnect said latching elements for joint displacement when said lid is in said second position thereof. Advantageously, said connecting element has at least a resilient portion which constitutes said urging means.

By resorting to the present invention, the operator of the sewing machine can readily and simply select desired stitching patterns in accordance with associated stitching types, and can make such machine adjustments as may be necessary, for instance by selecting the corresponding presser or other attachment, and by selecting a requisite needle position, feeding speed or zig-zag amplitude.

Moreover, the machine according to the present invention is so simple to operate that it requires no particular skill and does not adversely influence the speed and efficiency of the operator who uses the sewing machine.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Zig-zag sewing machines are too well known to require a detailed description as to their structure and operation. However, if further information is desired, reference may be had to the U.S. Pat. No. 3,641,957 wherein a zig-zag sewing machine is fully disclosed.

For the sake of simplicity, we have also omitted any illustration of pattern cams or a pattern cam selector mechanism which are of conventional constructions. A sewing machine using pattern cams and a pattern cam selector mechanism, and in which the present invention may for instance be utilized, is disclosed in the U.S. Pat. No. 3,433,092.

Figure 1:
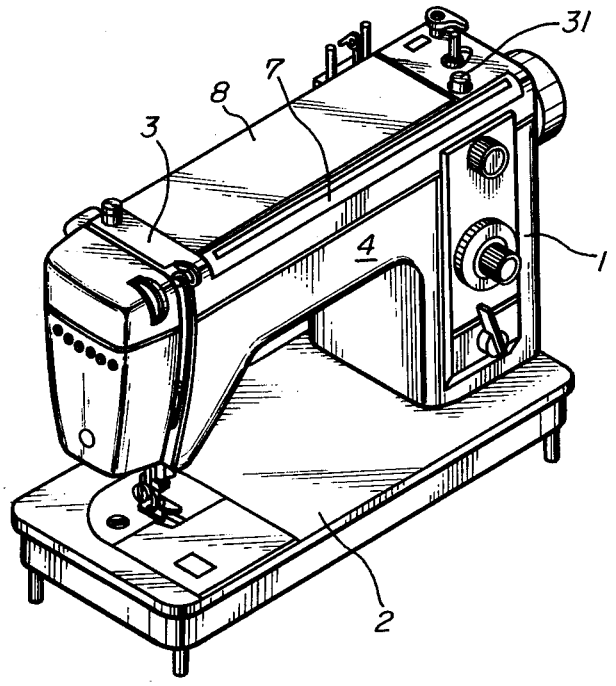
FIG. 1 is a perspective view of a sewing machine in which the present invention is used.

Referring to the drawings, and first to FIG. 1, the sewing machine in which the present invention is used is shown generally as having a machine frame including an upright portion 1 mounted on the machine bed 2, a cantilevered portion 4 extending from the upright portion 1 to above the machine bed 2 and a top cover plate 3 detachably mounted on the cantilevered portion 1. Numeral 8 designates an outer cover lid of the top cover plate 3, and a panel 7 for indicating various stitching patterns is mounted on the cantilevered portion 4. Furthermore, a push button 31 is mounted on the frame and will be described hereinafter.

Figure 2:
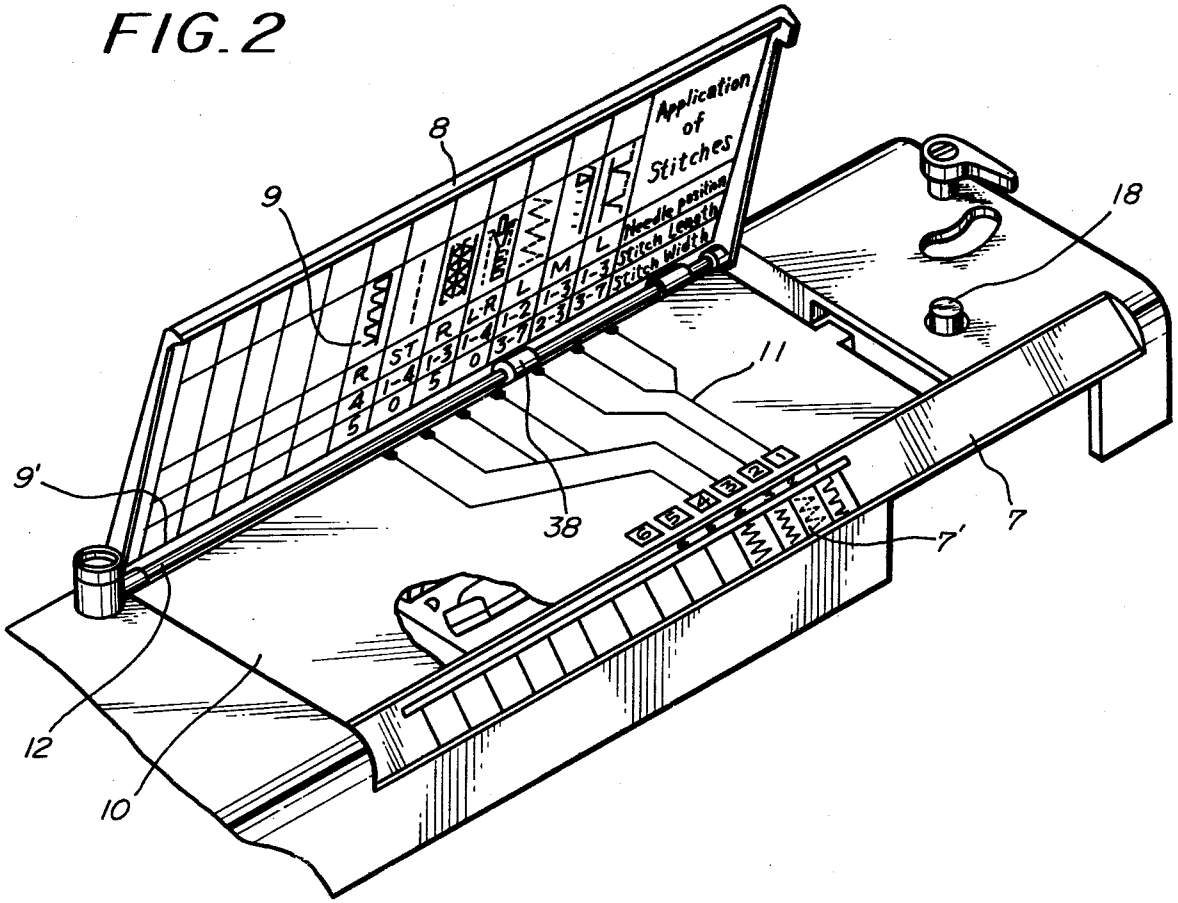
FIG. 2 is a perspective view of a part of the sewing machine of FIG. 1 in which the present invention is incorporated with one lid open.
Figure 3:
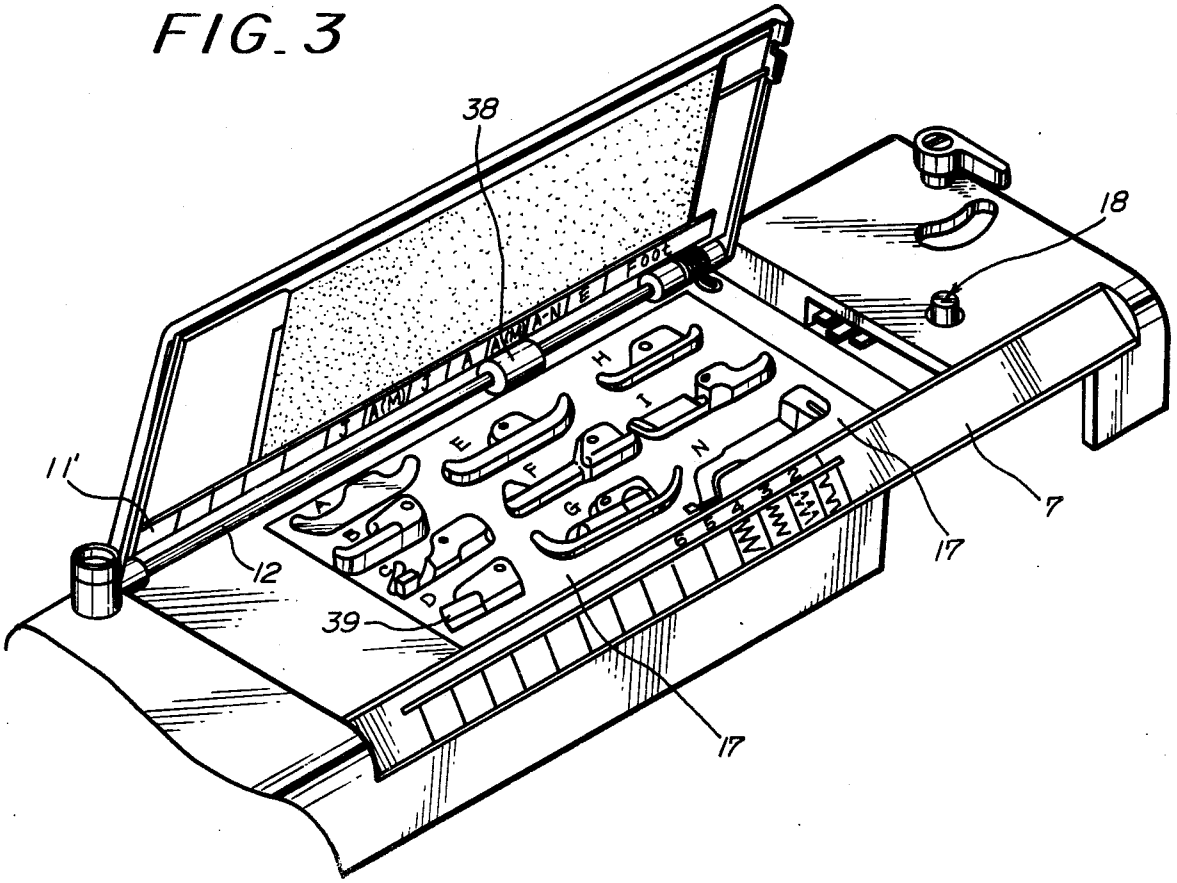
FIG. 3 is a view similar to FIG. 2, but with another lid open.
Figure 4:
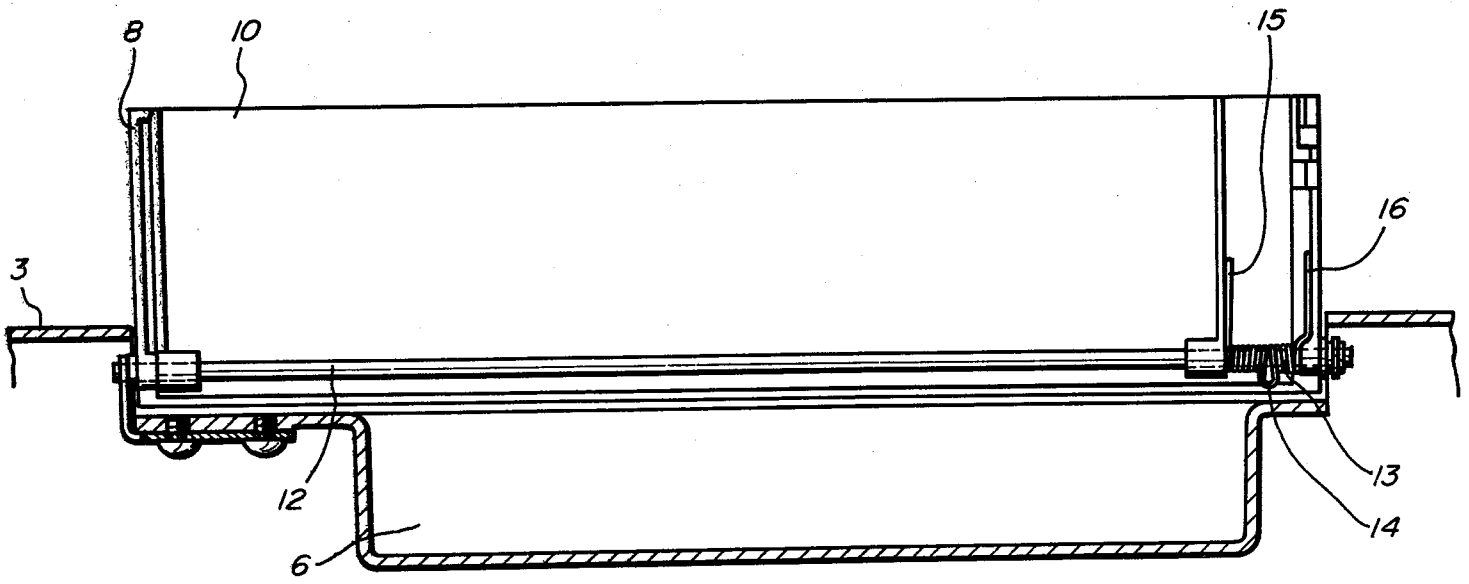
FIG. 4 is a sectional view of the part of the sewing machine illustrated in FIG. 3.
Figure 5:
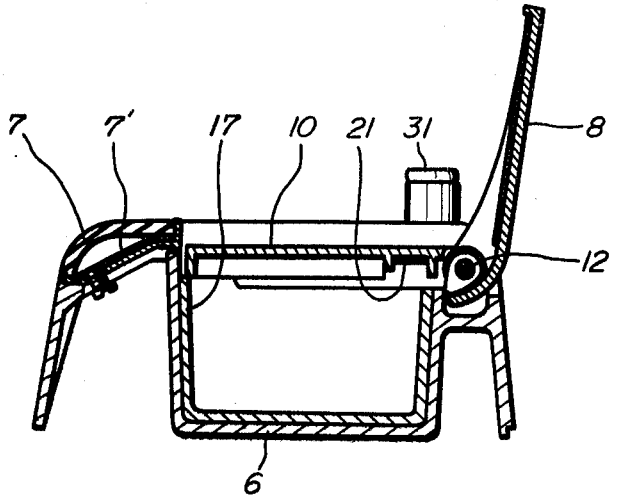
FIG. 5 is a cross-sectional view of the part illustrated in FIG. 2.
Figure 6:
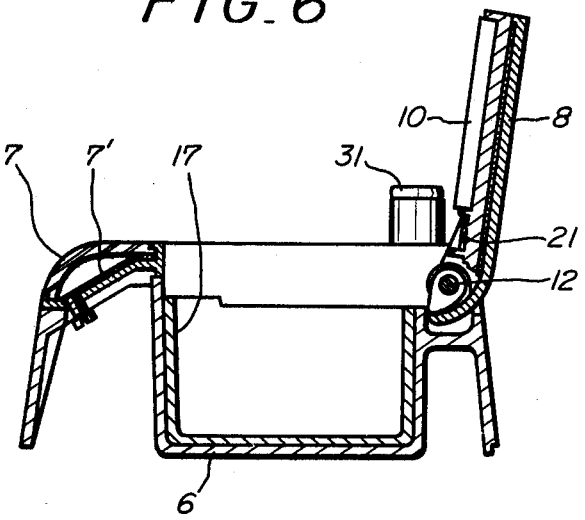
FIG. 6 is a cross-sectional view similar to FIG. 5 in a position according to FIG. 3.

As most clearly seen in FIGS. 4–6, the cover plate 3 is formed with a substantially rectangular container 6 bounding a compartment. As shown in FIGS. 2–4, a shaft 12 is fixed along the upper and rear edge of the container 6. The outer lid 8 and an inner lid 10 are pivotably mounted at the respective rear edges thereof on the shaft 12 for closing and opening the top cover plate 3 and the container 6, respectively. As shown in FIG. 4, a coil spring 13 is mounted around the shaft 12 at an end thereof. One end 15 of the coil spring 13 contacts the inner face of the inner lid 10. An other end 16 of the coil spring 13 contacts the inner face of the outer lid 8 and a central extension 14 of the coil spring 13 contacts the upper face of the top cover 3. Thus, the lids 8 and 10 are usually urged toward their open positions, respectively, by the coil spring 13. A case 17 for carrying attachments of the sewing machine is fitted into the container 6 of the top cover plate 3.

As shown in FIG. 2, the outer lid 8 carries on the inner surface thereof a table 9 which is provided with various columns displaying different informations such as applied stitches, and adjustment to be made to the sewing machine. For instance, letters or figures indicating needle positions, feeding speeds, zig-zag amplitude and pressing attachments and others may be indicated in the table 9. The inner lid 10 carries on the outer surface thereof correlating lines 11 which connect the vertical rows formed in the above-mentioned columns with corresponding indicia or patterns provided on a dial 7' which is arranged at the front part of the top cover plate 3 underneath the panel 7. The panel 7 is transparent and may be of an appropriate synthetic plastic resin, such as polyvinyl chloride.

As particularly shown in FIG. 3, columns 11' are provided on the inner face of the inner lid 10 adjacent to the rear edge thereof displaying indicia such as letters or figures indicating the respective pressing or other attachment which is carried in the case 17. These indicia correspond to those for the pressing or other attachments provided on the inner surface of the outer cover 8, and located in the same vertical rows formed in the above-mentioned columns.

In this connection, it is to be mentioned that as shown in FIGS. 2 and 3, a slide element 38 is mounted on the shaft 12 and is slidable along the shaft. The slide element 38 is provided to facilitate the selection of the pressing or other attachment carried in the case 17. Namely, as illustrated in FIG. 2, in which only the outer lid 8 is open, the slide element 38 is positioned at one of the vertical rows in the columns of the table 9 or at one of the connecting lines 11 after or before one of the stitching patterns on the dial 7' of a non-illustrated cam selecting mechanism is selected. In this condition, when the inner lid 10 is opened as shown in FIG. 6, a desired one of the pressing or other attachments A–N in the case 17 can be easily selected since the slide element 38 is positioned at the corresponding selected indicium on the lower lid 10.

Referring to FIGS. 7–11, it may be seen that an arresting arrangement is provided for holding the lids 8 and 10 in their closed positions and for releasing these lids 8 and 10 toward their open positions. The arresting arrangement is supported, laterally of the container 6, on a bracket 19 secured on the underside of the top cover plate 3 and is substantially composed of a first arresting element 22 having an arresting portion 23, a second arresting element 24 having another arresting portion 25, an engaging element 28 having an engaging end 29 and fixed to the underside of the first arresting element 22, and an actuating element 30 connected to the push button 31 which latter partly extends out of the top cover plate 3 so as to be accessible, and is shaped as a vertical shaft extending vertically downwardly through a hole provided in the bracket 19 and having an operating element 32 fixed at the lower end thereof. The operating element 32 has an actuating end 33 in engagement with the engaging end 29 of the engaging element 28.

Figure 7:
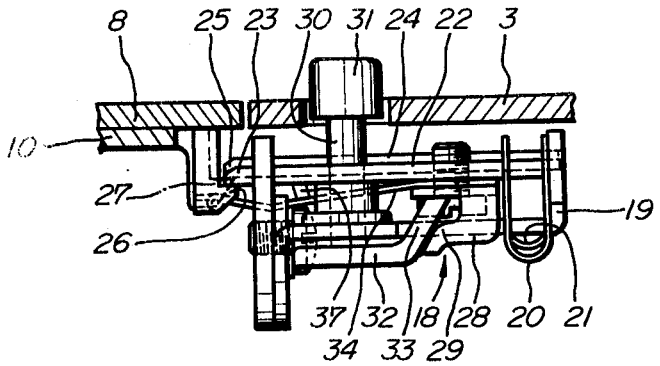
FIGS. 7–10 are front elevational views of an arresting arrangement of the present invention during various stages of operation thereof.
Figure 11:
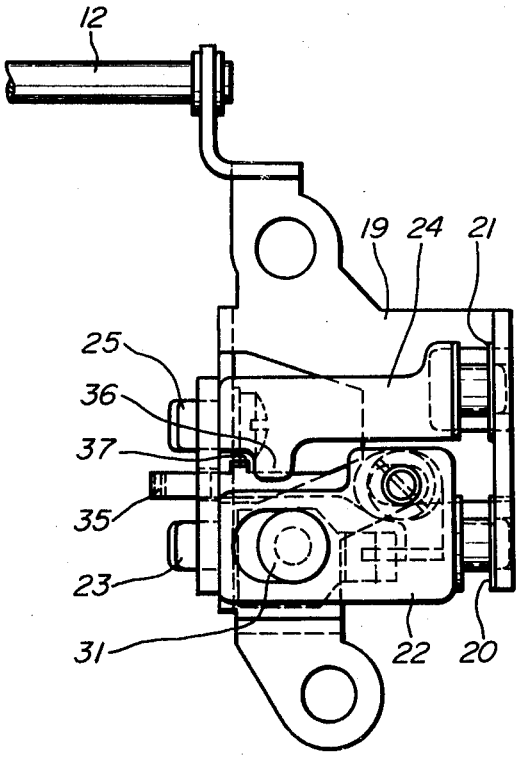
FIG. 11 is a top plan view of the arresting arrangement of FIGS. 7 to 10.

A connecting element 34 is provided, preferably in the form of a leaf spring which is fixed at one end thereof to the first arresting element 22 and has a free end 35 and an upper projection 37 at the intermediate portion thereof. The first and second arresting elements 22 and 24 are supported on the bracket 19 and usually urged in the leftward direction by U-shaped springs 20 and 21, respectively, which are arranged between the bracket 19 and the right-hand ends of the arresting elements 22 and 24 as shown in FIGS. 7 and 11. As particularly shown in FIGS. 9 and 11, the second arresting element 24 is provided with a lateral projection 36 which cooperates with the upper projection 37 of the connecting element 34 as described hereinafter.

Figure 8:
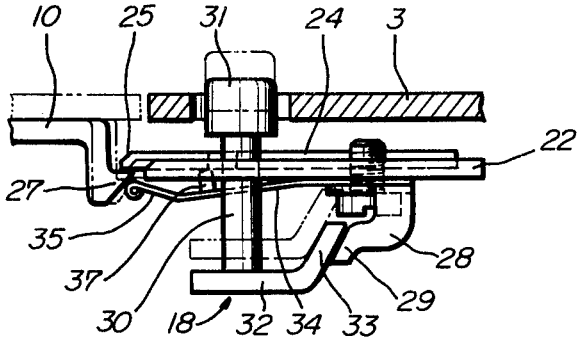
Figure 9:
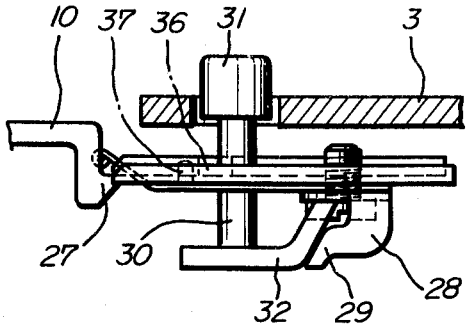
Figure 10:
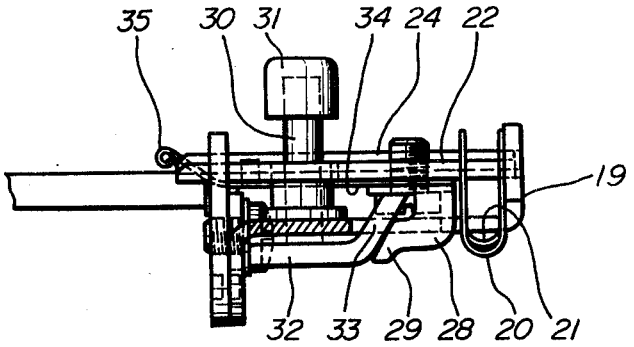

As shown in FIGS. 7–9, when the outer and inner lids 8 and 10 are closed against the action of the coil spring 13, the arresting portion 23 at the free end of the first arresting element 22 snaps into engagement with an abutment portion 26 of the outer lid 8, and the arresting portion 25 at the free end of the second arresting element 24 snaps into engagement with an abutment 27 of the inner lid 10. Thus, the outer and inner lids 8 and 10 are held in their closed positions respectively, and the actuating element 30, and the push button 31, are held in a raised position as shown in FIG. 7 due to the biasing action of the U-shaped spring 20 imparted to the actuating element 30 through the first arresting element 22 and the engaging element 28 which acts to raise the actuating element 30 due to the sliding engagement with the actuating end 33 of the operating element 32. In this instance, the connecting element 34 is kept in a downwardly pushed position by the outer lid 8 as shown in FIG. 7, and the upper projection 37 of the connecting element 34 is positioned below the level of the second arresting element 24 and out of engagement therewith.

In order to select a specific stitching pattern by resorting to this invention, the push button 31 of the activating element 30 is pushed, and the operating element 32 at the lower end of the control element is displaced downwardly. The downward movement of the operating element 32 shifts the engaging element 28 in the rightward direction against the action of the U-shaped spring 20. The first arresting element 22 is, therefore, shifted in the same direction, and the arresting portion 23 of the arresting element 22 is moved out of engagement with the abutment portion 26 of the outer lid 8, as shown in FIG. 8. Thus, the outer lid 8 is displaced to the open position shown in FIG. 2 by means of the action of the coil spring 13, and the operator of the sewing machine can appropriately select a desired stitching pattern in reference to the table 9 on the open outer lid 8, connecting lines 13 on the still closed inner lid 10, stitching patterns provided on the front part of the top cover plate 3, and by selectively positioning the slide element 38.

After the outer lid 8 has been opened, the connecting element 34 is released from the pressure of the outer lid 8 and moves to the upper position as shown in FIGS. 9 and 11 where the upper projection 37 of the connecting element 34 is located at the same level as the arresting element 24 and is located adjacent to the left side of the lateral projection 36 of the arresting element 24. When the push button 31 of the control element is pushed again, the first arresting element 22 is shifted in the rightward direction in the same manner as aforementioned. At the same time the second arresting element 24 is shifted in the same direction against the action of the U-shaped spring 21 together with the first arresting element 22, due to the engagement of the lateral projection 36 of the second arresting element 24 with the upper projection 37 of the connecting element 34 which is fixed to the first arresting element 22. The arresting portion 25 of the second arresting element 24 is, therefore, moved out of engagement with the abutment portion 27 of the inner lid 10, and the inner lid is displaced to the open position by means of the action of the coil spring 13. Thus, the pressing or other attachments carried in the case 17 fitted into the container 6 of the top cover plate 3 become accessible, and a desired one of these attachments can be easily selected with reference to the slide element 38 which has been selectively positioned beforehand as aforementioned.

On the other hand, when the container 6 is to be closed, the inner lid 10 is lowered first, displacing the arresting element 24 against the force of the spring 21, and then the outer lid 8 is lowered, displacing the arresting element against the action of the spring 20, so that the arresting portions 23 and 25 engage behind the abutment portions 26 and 27, respectively. Simultaneously therewith, the displacement of the outer lid 8 results in disengagement of the upper projection 37 of the connecting element 34 from the lateral projection 36 of the arresting element 24, after which the entire operation can be repeated.

It will be understood that each of the elements described above, or two or more together, may also find a useful application in other types of constructions differing from the types described above.

While the invention has been illustrated and described as embodied in a zig-zag sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a zig-zag sewing machine of the type having a machine frame, pattern cams, and a pattern cam selecting mechanism including a selector dial which displays a plurality of indicia each representative of a stitching pattern which is produced upon selection of one of the pattern cams, a combination comprising container means attached to the machine frame and defining a compartment for accommodating various attachments of the sewing machine; a shaft supported on the machine frame at said compartment; a first lid mounted on said shaft for pivoting between an open position in which it permits, and a closed position in which it prevents, access to said compartment and in which it extends between said shaft and the selector dial; a second lid mounted on said shaft for pivoting between a first position in which it covers, and a second position in which it uncovers, said first lid; a table on that surface of said second lid which is concealed in said first, and exposed to view in said second position of said second lid and displaying additional indicia at least some of which are indicative of sewing machine adjustments to be carried out upon selection of a respective pattern cam; means for correlating the respective indicia on the selector dial with associated ones of said additional indicia on said second lid, being provided on that surface of said first lid which is exposed to view when said second lid assumes said second and said first lid is in said closed position thereof; and an indicating element mounted on said shaft for displacement therealong and visible both when said first lid is in said closed position and in said open position thereof and operative for being selectively positioned on said shaft in dependence on the selected indicia, when said first lid is in said closed position and for indicating the respective attachment of the sewing machine to be used, when said first lid is in said open position.

2. In a zig-zag sewing machine of the type having a machine frame, pattern cams, and a pattern cam selecting mechanism including a selector dial which displays a plurality of indicia each representative of a stitching pattern which is produced upon selection of one of the pattern cams, a combination comprising container means attached to the machine frame and defining a compartment for accommodating various attachments of the sewing machine; a shaft supported on the machine frame at said compartment; a first lid mounted on said shaft for pivoting between an open position in which it permits, and a closed position in which it prevents, access to said compartment; a second lid mounted on said shaft for pivoting between a first position in which it covers, and a second position in which it uncovers, said first lid; a table on that surface of said second lid which is exposed to view only in said second position of said second lid and displaying additional indicia at least some of which are indicative of sewing machine adjustments to be carried out upon selection of a respective pattern cam; and an indicating element mounted on said shaft for displacement therealong and visible both when said first lid is in said closed position and in said open position thereof and operative for being selectively positioned on said shaft in dependence on the selected indicia in said closed position of said first lid and for indicating the respective attachment of the sewing machine to be used in said open position of said first lid.

3. A combination as defined in claim 2, and further comprising means for arresting said lid and said additional lid in said first and in said closed positions thereof, respectively, and including an actuating element accessible from the exterior of the sewing machine.

4. A combination as defined in claim 3, wherein said lid has an abutment portion; and wherein said arresting means includes a latching element mounted on the machine frame for displacement into and out of engagement with said abutment portion and connected to said actuating element for displacement in response to actuation of the latter.

5. In a zig-zag sewing machine of the type having a machine frame, pattern cams, and a pattern cam selecting mechanism including a selector dial which displays a plurality of indicia each representative of a stitching pattern which is produced upon selection of one of the pattern cams, a combination comprising container means attached to the machine frame and defining a compartment for accommodating various attachments of the sewing machine; a first lid mounted on the machine frame for displacement between an open position in which it permits, and a closed position in which it prevents, access to said compartment and in which it extends toward the selector dial, and having a first abutment portion; a second lid mounted on the machine frame for displacement between a first position in which it covers, and a second position in which it uncovers, said first lid, and having a second abutment portion; a table on that surface of said second lid which is concealed in said first, and exposed to view in said second position of said second lid and displaying additional indicia at least some of which are indicative of sewing machine adjustments to be carried out upon selection of a respective pattern cam; means for correlating the respective indicia on the selector dial with associated ones of said additional indicia on said second lid, being provided on that surface of said first lid which is exposed to view when said second lid assumes said second and said first lid is in said closed position thereof; and means for arresting said first and second lids in said first and closed positions thereof, respectively, including an actuating element accessible from the exterior of the sewing machine. a first latching element mounted on the machine frame for displacement into and out of engagement with said first abutment portion, means for connecting said first latching element to said actuating element for displacement of said firt latching element in response to actuating of said actuating element, and a second latching element mounted on the machine frame for displacement into and out of engagement with said second abutment portion and connected to said actuating element for displacement in response to actuation of the latter.

6. In a zig-zag sewing machine of the type having a machine frame, pattern cams, and a pattern cam selecting mechanism including a selector dial for the selection of the pattern cams, a combination comprising container means attached to the machine frame and defining a compartment for accommodating various attachments of the sewing machine; a first lid mounted on the machine frame for displacement between an open position in which it permits, and a closed position in which it prevents, access to said compartment, and having a first abutment portion; a second lid mounted on the machine frame for displacement between a first position in which it covers, and a second position in which it uncovers, said first lid, and having a second abutment portion; and means for arresting said first and second lids in said first and closed positions thereof, respectively, including an actuating element accessible from the exterior of the sewing machine, a first latching element mounted on the machine frame for displacement into and out of engagement with said first abutment portion, means for connecting said first latching element to said actuating element for displacement of said first latching element in response to actuating of said actuating element, and a second latching element mounted on the machine frame for displacement into and out of engagement with said second abutment portion and connected to said actuating element for displacement in response to actuation of the latter.

7. A combination as defined in claim 6; and further comprising a shaft supported on the machine frame; and wherein said lid and said additional lid are both mounted on said shaft for pivoting between said first and second, and said closed and open, positions thereof, respectively.

8. A combination as defined in claim 6, wherein said connecting means includes a connecting element adapted to engage said additional latching element; and wherein said lid has a control portion which disengages said connecting element from said additional latching element when said lid is in said first position, and releases said connecting element for engagement with said additional latching element when said lid is in said second position.

9. A combination as defined in claim 8, wherein said connecting element is connected to said latching element and has a first engaging portion; wherein said additional latching element has a second engaging portion; and wherein said connecting means includes means for urging said engaging portions toward engagement with one another and to thereby interconnect said latching elements for joint displacement when said lid is in said second position thereof.

10. A combination as defined in claim 9, wherein said connecting element has at least a resilient portion which constitutes said urging means.

11. A combination as defined in claim 6, wherein said arresting means includes an operating element connected to said actuating element, and an engaging element connected to said latching element, said operating and engagement elements cooperating to displace said latching element in response to the actuation of said actuating element.

* * * * *